US008018305B2

(12) United States Patent
Tomaki et al.

(10) Patent No.: US 8,018,305 B2
(45) Date of Patent: Sep. 13, 2011

(54) ELECTRONIC COMPONENT

(75) Inventors: Shigemitsu Tomaki, Tokyo (JP); Noriaki Ootsuka, Tokyo (JP); Yoshikazu Tsuya, Tokyo (JP); Kazushige Shinoda, Tokyo (JP)

(73) Assignee: TDK Corporation, Tokyo (JP)

( * ) Notice: Subject to any disclaimer, the term of this patent is extended or adjusted under 35 U.S.C. 154(b) by 509 days.

(21) Appl. No.: 12/289,083

(22) Filed: Oct. 20, 2008

(65) Prior Publication Data

US 2009/0121813 A1 May 14, 2009

(30) Foreign Application Priority Data

Nov. 12, 2007 (JP) ..... 2007-292820

(51) Int. Cl.
*H01P 1/205* (2006.01)
*H01P 7/08* (2006.01)

(52) U.S. Cl. ..... 333/203; 333/185; 333/219

(58) Field of Classification Search ..... 333/165–168, 333/172, 175, 176, 185, 219, 202–205, 235, 333/81 R See application file for complete search history.

(56) References Cited

U.S. PATENT DOCUMENTS

| | | | |
|---|---|---|---|
| 5,892,415 | A | 4/1999 | Okamura |
| 7,541,896 | B2 | 6/2009 | Fukunaga |
| 2007/0171005 | A1 | 7/2007 | Fukunaga |

FOREIGN PATENT DOCUMENTS

| | | |
|---|---|---|
| JP | A-9-148802 | 6/1997 |
| JP | A-2001-119209 | 4/2001 |
| JP | A-2005-12258 | 1/2005 |
| JP | A-2005-159512 | 6/2005 |
| JP | A-2007-201763 | 8/2007 |
| JP | A-2007-235857 | 9/2007 |

OTHER PUBLICATIONS

Aug. 9, 2010 Office Action issued in Japanese Patent Application No. 2007-292820 (with translation).

*Primary Examiner* — Robert Pascal
*Assistant Examiner* — Gerald Stevens
(74) *Attorney, Agent, or Firm* — Oliff & Berridge, PLC

(57) ABSTRACT

An electronic component includes first and second resonators provided within a layered substrate including stacked dielectric layers. The first resonator includes resonator-forming conductor layers of a first type and a second type. The resonator-forming conductor layers of the first type and the second type are reversed in relative positions of the short-circuited end and the open-circuited end, and are alternately arranged in the stacking direction of the dielectric layers. An input terminal is connected to all of the resonator-forming conductor layers of the first type. The second resonator includes resonator-forming conductor layers of a third type and a fourth type. The resonator-forming conductor layers of the third type and the fourth type are reversed in relative positions of the short-circuited end and the open-circuited end, and are alternately arranged in the stacking direction of the dielectric layers. An output terminal is connected to all of the resonator-forming conductor layers of the third type.

5 Claims, 12 Drawing Sheets

ELECTRONIC COMPONENT

BACKGROUND OF THE INVENTION

1. Field of the Invention

The present invention relates to an electronic component including a plurality of resonators provided within a layered substrate.

2. Description of the Related Art

There are strong demands for reductions in size and thickness of communication apparatuses for short-range wireless communications, such as communication apparatuses conforming to the Bluetooth standard and communication apparatuses for use on a wireless local area network (LAN). Accordingly, reductions in size and thickness are also demanded of electronic components incorporated in such communication apparatuses. A bandpass filter that filters reception signals is one of electronic components incorporated in the communication apparatuses mentioned above. Reductions in size and thickness are also demanded of the bandpass filter. To meet the demands, a layered filter including a plurality of resonators each formed using at least one conductor layer of a layered substrate has been proposed as a bandpass filter that is operable in the frequency bands used for the above-mentioned communication apparatuses and capable of achieving reductions in size and thickness. Such a layered filter is disclosed in, for example, JP-A-9-148802, JP-A-2001-119209, JP-A-2005-012258 and JP-A-2005-159512. Hereinafter, a conductor layer used for forming a resonator is referred to as a resonator-forming conductor layer.

JP-A-9-148802 discloses a layered bandpass filter including at least two resonators. In this bandpass filter, each of the resonators incorporates two types of internal electrodes that are alternately arranged in the stacking direction and that each have a short-circuited end and an open-circuited end whose relative positions are reversed between the two types.

JP-A-2001-119209 discloses a layered filter module including a plurality of filters, each of the filters including a plurality of inductor-forming conductors. Each of the filters of this module incorporates three resonators formed using the inductor-forming conductors. In this module, the inductor-forming conductors in every adjacent filters do not include portions extending in parallel with each other along the entire length.

FIG. 7 of JP-A-2005-012258 shows a bandpass filter including four resonators. In this bandpass filter, each of the resonators incorporates two types of capacitance-forming electrodes that are alternately arranged in the stacking direction and that each have a short-circuited end and an open-circuited end whose relative positions are reversed between the two types. FIG. 1 of this publication shows a bandpass filter including three resonators Q1, Q2 and Q3. In this bandpass filter, the resonators Q1, Q2 and Q3 incorporate their respective strip lines for inductors. The strip lines of the resonators Q1 and Q2 are combline-coupled to each other, while the strip lines of the resonators Q2 and Q3 are interdigital-coupled to each other.

JP-A-2005-159512 discloses a layered bandpass filter including three resonator electrodes arranged side by side on one dielectric layer. The three resonator electrodes of this bandpass filter are disposed in a combline form or an interdigital form.

Typically, a bandpass filter including a plurality of resonators exhibits a broader passband width and a steeper attenuation pole as the number of the resonators increases.

For a conventional layered bandpass filter including a plurality of resonators, it is required to reduce the distance between every adjacent resonators in order to achieve reductions in size and thickness. If this is done, however, the inductive coupling between every adjacent resonators becomes too strong, so that it becomes difficult to attain desired filter characteristics. Specifically, the passband width of the filter becomes too broad if the inductive coupling between adjacent resonators becomes too strong.

For reducing the inductive coupling between every adjacent resonators in a layered bandpass filter without interfering with reductions in filter size and thickness, a possible approach is to reduce the width of each resonator-forming conductor layer to thereby increase the distance between every adjacent resonators. However, this reduces the Qs of all of the resonators.

To increase the resonator Q, it is effective to increase the surface area of the resonator-forming conductor layer. In view of this, each resonator can be formed using a plurality of resonator-forming conductor layers so as to increase the distance between every adjacent resonators to some extent without reducing the resonator Q. In this case, each resonator can be formed of resonator-forming conductor layers of two types that are alternately arranged in the stacking direction and that each have a short-circuited end and an open-circuited end whose relative positions are reversed between the two types, as proposed in JP-A-9-148802 or JP-A-2005-012258. In this case, the resonator-forming conductor layers of the two types alternately arranged in the stacking direction are interdigital-coupled to each other, thereby constituting a resonator including an inductor and a capacitor.

In the layered bandpass filter disclosed in JP-A-9-148802, a lead-out electrode connected to an external electrode for input/output is electrically coupled to one of the internal electrodes by capacitive, inductive or direct coupling. In the bandpass filter disclosed in FIG. 7 of JP-A-2005-012258, a lead-out electrode connected to an input terminal electrode and a lead-out electrode connected to an output terminal electrode are each connected to one of the capacitance-forming electrodes. Thus, JP-A-9-148802 and JP-A-2005-012258 teach that, of the resonator-forming conductor layers of the two types that are alternately arranged in the stacking direction and that are reversed in relative positions of the short-circuited end and the open-circuited end, a single resonator-forming conductor layer of one of the two types connects to a terminal for input or output of signals. This configuration cannot greatly increase the Q of the resonator connected to the terminal for input or output of signals.

OBJECT AND SUMMARY OF THE INVENTION

It is an object of the present invention to provide an electronic component including at least one resonator provided within a layered substrate, the electronic component being capable of increasing the Q of the resonator connected to a terminal used for at least one of input and output of signals.

A first electronic component of the present invention includes: a layered substrate including a plurality of dielectric layers stacked; a terminal provided on a periphery of the layered substrate and used for at least one of input and output of signals; and a resonator provided within the layered substrate and connected to the terminal. The resonator includes a plurality of resonator-forming conductor layers of a first type and at least one resonator-forming conductor layer of a second type. The resonator-forming conductor layers of the first type and the second type each have a short-circuited end and an open-circuited end, relative positions of the short-circuited end and the open-circuited end being reversed between the first and second types. The resonator-forming conductor layers of the first type and the second type are alternately arranged in a direction in which the plurality of dielectric layers are stacked. The terminal is directly connected to all of the resonator-forming conductor layers of the first type. It should be noted that the phrase "directly connected" herein means connection through a conductor, not by electromagnetic coupling.

In the first electronic component of the present invention, the resonator may be a quarter-wave resonator having a short-circuited end and an open-circuited end.

A second electronic component of the present invention includes: a layered substrate including a plurality of dielectric layers stacked; an input terminal provided on a periphery of the layered substrate and used for input of signals; an output terminal provided on the periphery of the layered substrate and used for output of signals; a first resonator provided within the layered substrate and connected to the input terminal; and a second resonator provided within the layered substrate and connected to the output terminal. The first resonator includes a plurality of resonator-forming conductor layers of a first type and at least one resonator-forming conductor layer of a second type. The resonator-forming conductor layers of the first type and the second type each have a short-circuited end and an open-circuited end, relative positions of the short-circuited end and the open-circuited end being reversed between the first and second types. The resonator-forming conductor layers of the first type and the second type are alternately arranged in a direction in which the plurality of dielectric layers are stacked. The input terminal is directly connected to all of the resonator-forming conductor layers of the first type. The second resonator includes a plurality of resonator-forming conductor layers of a third type and at least one resonator-forming conductor layer of a fourth type. The resonator-forming conductor layers of the third type and the fourth type each have a short-circuited end and an open-circuited end, relative positions of the short-circuited end and the open-circuited end being reversed between the third and fourth types. The resonator-forming conductor layers of the third type and the fourth type are alternately arranged in the direction in which the plurality of dielectric layers are stacked. The output terminal is directly connected to all of the resonator-forming conductor layers of the third type.

In the second electronic component of the present invention, each of the first and second resonators may be a quarter-wave resonator having a short-circuited end and an open-circuited end.

In the second electronic component of the present invention, the first and second resonators may be located between the input terminal and the output terminal in terms of circuit configuration, and may implement the function of a bandpass filter. It should be noted that the phrase "in terms of circuit configuration" used herein is intended to mean positioning in a schematic circuit diagram, not in the physical configuration.

According to the first electronic component of the present invention, the terminal used for at least one of input and output of signals is directly connected to all of the resonator-forming conductor layers of the first type. This serves to increase the Q of the resonator connected to the terminal.

According to the second electronic component of the present invention, the input terminal is directly connected to all of the resonator-forming conductor layers of the first type of the first resonator, and the output terminal is directly connected to all of the resonator-forming conductor layers of the third type of the second resonator. This serves to increase the Qs of the first and second resonators.

Other and further objects, features and advantages of the invention will appear more fully from the following description.

DETAILED DESCRIPTION OF THE PREFERRED EMBODIMENT

Figure 3:
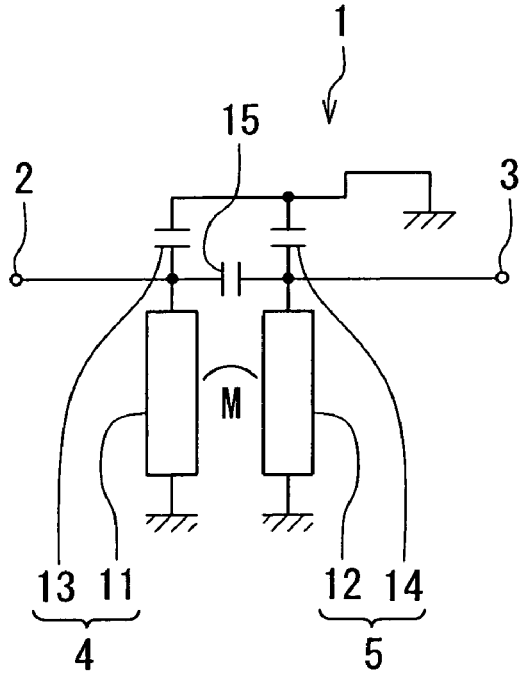
FIG. 3 is a schematic diagram showing the circuit configuration of the electronic component of the embodiment of the invention.

A preferred embodiment of the present invention will now be described in detail with reference to the drawings. Reference is first made to FIG. 3 to describe the circuit configuration of an electronic component of the preferred embodiment of the invention. The electronic component 1 of the present embodiment has the function of a bandpass filter. As shown in FIG. 3, the electronic component 1 includes an input terminal 2 used for input of signals, an output terminal 3 used for output of signals, two resonators 4 and 5, and a capacitor 15.

The resonator 4 includes an inductor 11 and a capacitor 13. The resonator 5 includes an inductor 12 and a capacitor 14. The resonators 4 and 5 are inductively coupled to each other. The inductors 11 and 12 are also inductively coupled to each other. In FIG. 3 the inductive coupling between the inductors 11 and 12 is shown with a curve M.

One end of the inductor 11 and one end of each of the capacitors 13 and 15 are connected to the input terminal 2. The other end of the inductor 11 and the other end of the capacitor 13 are connected to the ground. One end of the inductor 12, one end of the capacitor 14 and the output terminal 3 are connected to the other end of the capacitor 15. The other end of the inductor 12 and the other end of the capacitor 14 are connected to the ground.

The resonators 4 and 5 are located between the input terminal 2 and the output terminal 3 in terms of circuit configuration, and implement the function of a bandpass filter. Each of the resonators 4 and 5 is a quarter-wave resonator having a short-circuited end and an open-circuited end. The resonators 4 and 5 correspond to the first resonator and the second resonator, respectively, of the present invention.

When signals are received at the input terminal 2 of the electronic component 1, among the signals, those of frequencies within a certain frequency band selectively pass through the bandpass filter formed using the resonators 4 and 5, and are outputted from the output terminal 3.

Figure 1:
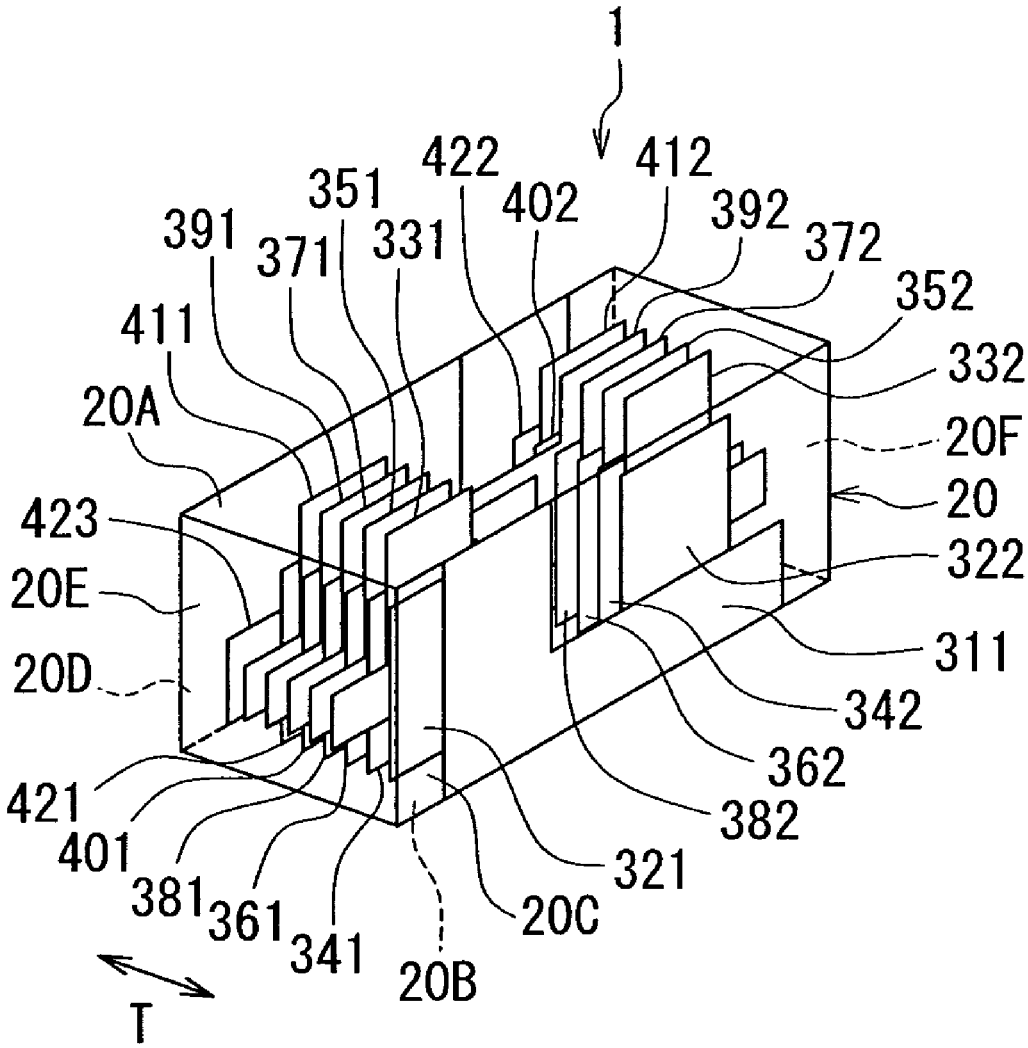
FIG. 1 is a perspective view showing a main part of an electronic component of an embodiment of the invention.
Figure 2:
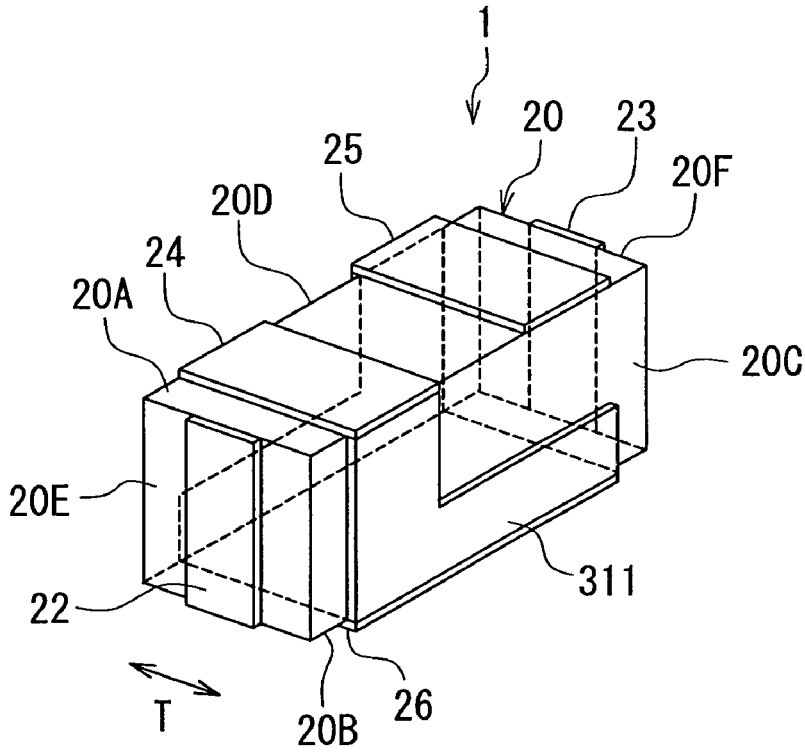
FIG. 2 is a perspective view showing the outer appearance of the electronic component of the embodiment of the invention.

Reference is now made to FIG. 1 and FIG. 2 to outline the structure of the electronic component 1. FIG. 1 is a perspective view showing a main part of the electronic component 1. FIG. 2 is a perspective view showing the outer appearance of the electronic component 1.

The electronic component 1 includes a layered substrate 20 for integrating the components of the electronic component 1. As will be described in detail later, the layered substrate 20 includes a plurality of dielectric layers and a plurality of conductor layers that are stacked. Each of the inductors 11 and 12 is formed using two or more of the conductor layers located within the layered substrate 20. Each of the capacitors 13 to 15 is formed using two or more of the conductor layers and one or more of the dielectric layers located within the layered substrate 20.

As shown in FIG. 2, the layered substrate 20 is rectangular-solid-shaped and has a top surface 20A, a bottom surface 20B and four side surfaces 20C to 20F, as the periphery. The top surface 20A and the bottom surface 20B are parallel to each other, the side surfaces 20C and 20D are parallel to each other, and the side surfaces 20E and 20F are parallel to each other. The side surfaces 20C to 20F are each perpendicular to the top surface 20A and the bottom surface 20B. An input terminal 22 is provided on the side surface 20E, and an output terminal 23 is provided on the side surface 20F. Two grounding terminals 24 and 25 are provided on the top surface 20A, and a grounding terminal 26 is provided on the bottom surface 20B. The input terminal 22 corresponds to the input terminal 2 of FIG. 3, and the output terminal 23 corresponds to the output terminal 3 of FIG. 3. The grounding terminals 24, 25 and 26 are connected to the ground.

For the layered substrate 20, the direction perpendicular to the side surfaces 20C and 20D is the direction in which the plurality of dielectric layers are stacked. In FIG. 1 and FIG. 2 the arrow T indicates the direction in which the plurality of dielectric layers are stacked.

Figure 4A:
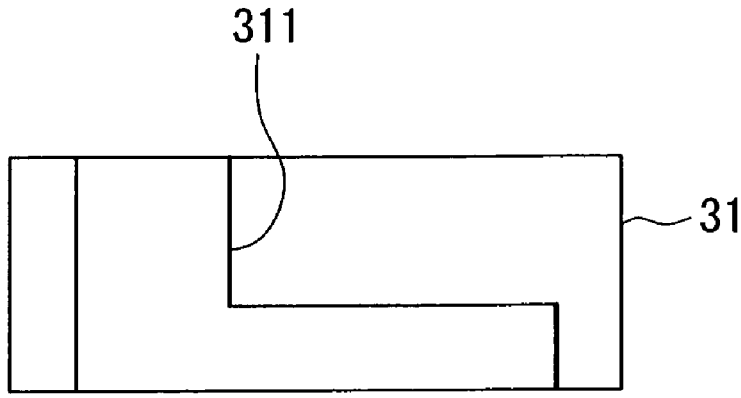
FIG. 4A to FIG. 4C are illustrative views respectively showing the top surfaces of first to third dielectric layers of a layered substrate of the embodiment of the invention.
Figure 5A:
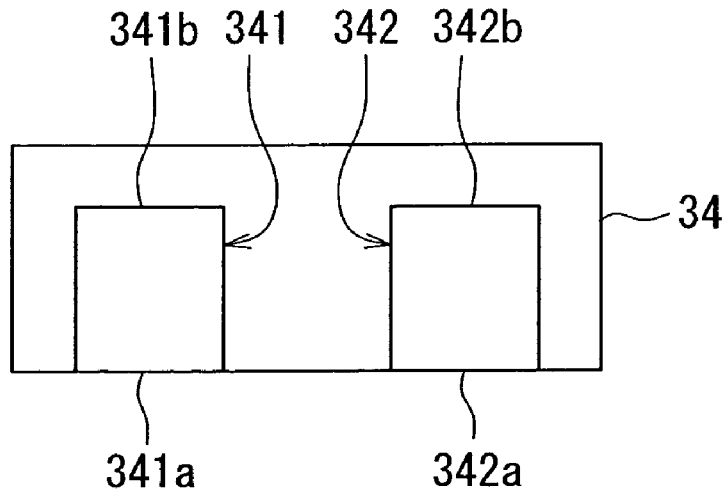
FIG. 5A to FIG. 5C are illustrative views respectively showing the top surfaces of fourth to sixth dielectric layers of the layered substrate of the embodiment of the invention.
Figure 5B:
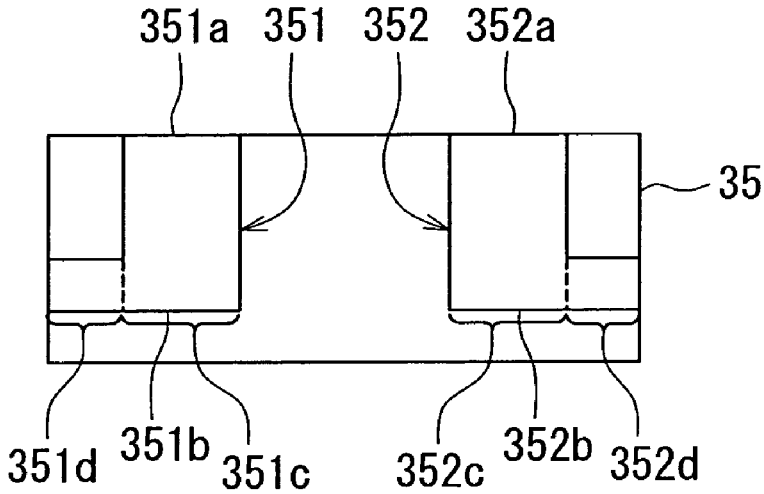
Figure 5C:
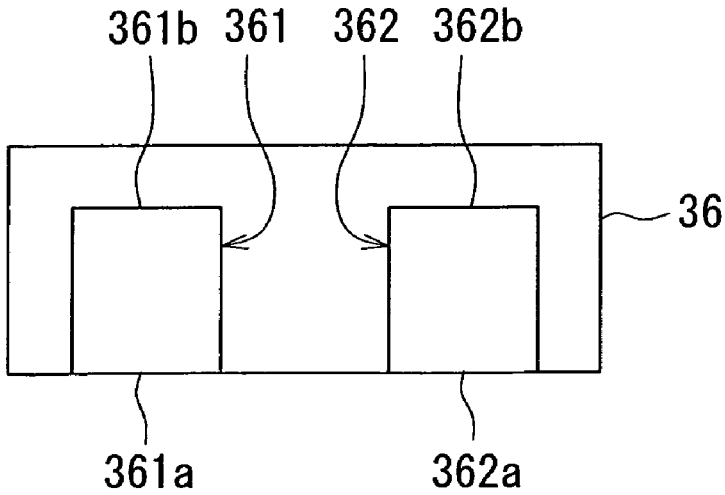
Figure 6A:
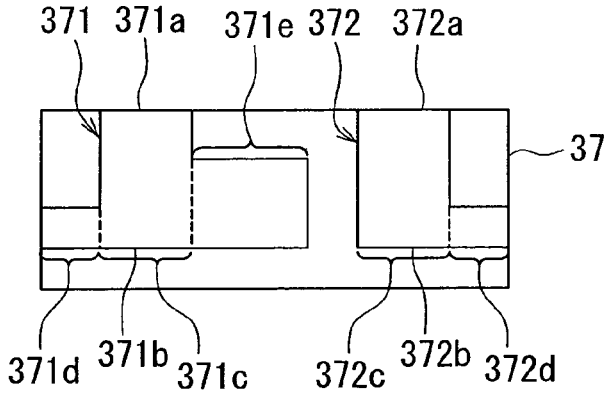
FIG. 6A to FIG. 6D are illustrative views respectively showing the top surfaces of seventh to tenth dielectric layers of the layered substrate of the embodiment of the invention.
Figure 6B:
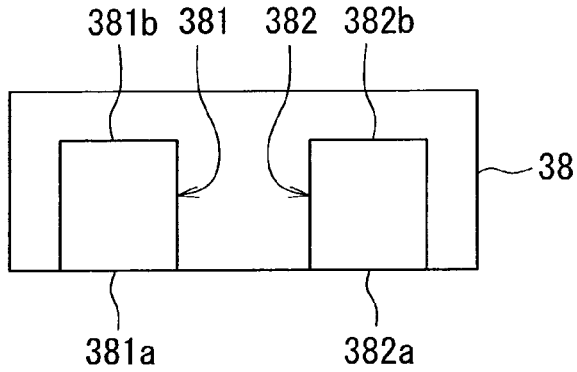
Figure 6C:
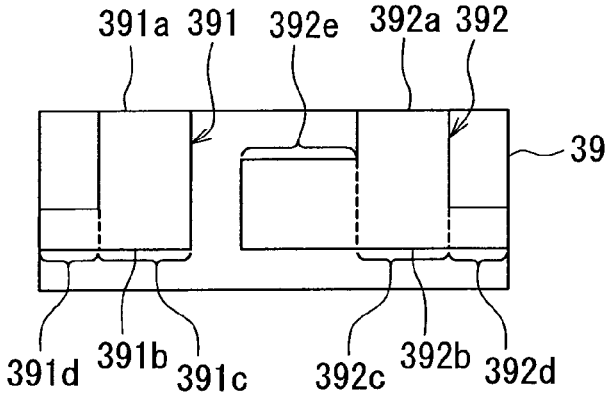
Figure 6D:
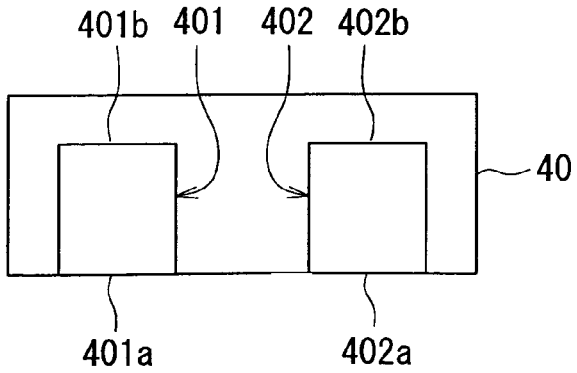
Figure 7A:
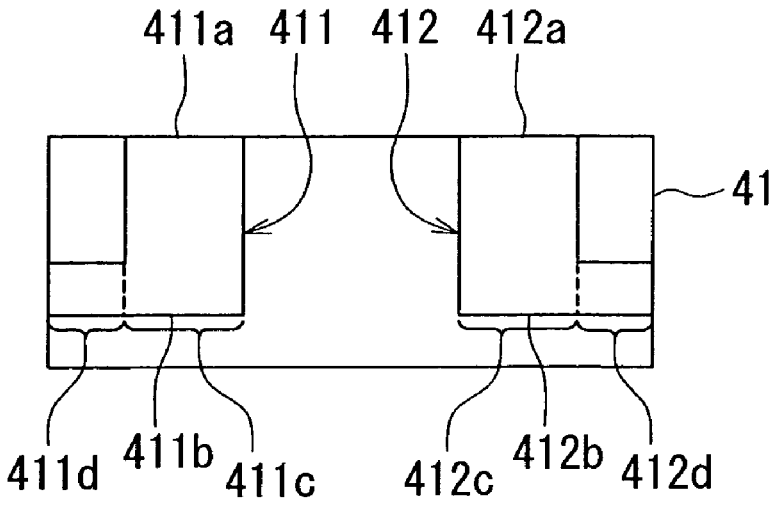
FIG. 7A to FIG. 7C are illustrative views showing the top surfaces of eleventh and twelfth dielectric layers of the layered substrate of the embodiment of the invention and the bottom surface of the twelfth dielectric layer, respectively.
Figure 7B:
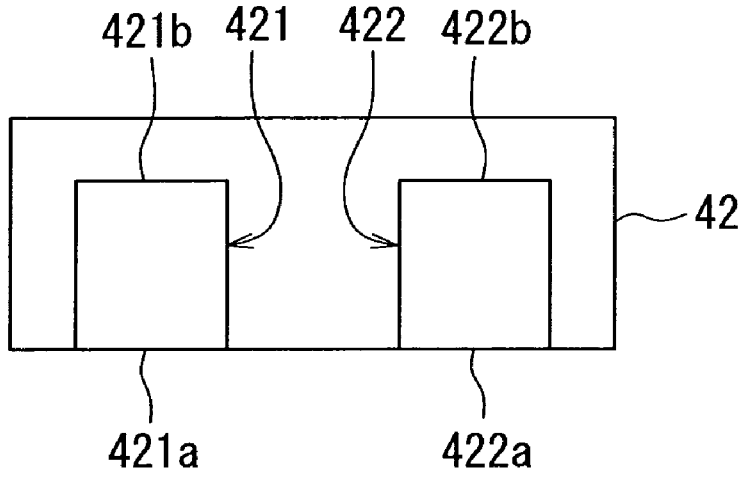
Figure 7C:
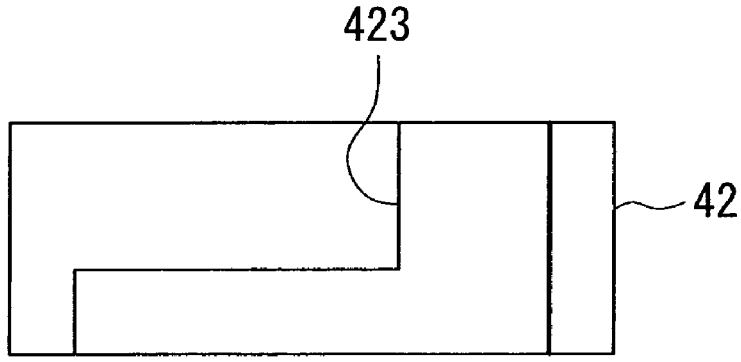

Reference is now made to FIG. 4A to FIG. 7C to describe the dielectric layers and the conductor layers of the layered substrate 20 in detail. FIG. 4A to FIG. 4C respectively show the top surfaces of the first to third dielectric layers from the top. FIG. 5A to FIG. 5C respectively show the top surfaces of the fourth to sixth dielectric layers from the top. FIG. 6A to FIG. 6D respectively show the top surfaces of the seventh to tenth dielectric layers from the top. FIG. 7A and FIG. 7B respectively show the top surfaces of the eleventh and twelfth dielectric layers from the top. FIG. 7C shows the twelfth dielectric layer and a conductor layer located therebelow as seen from above.

A grounding conductor layer 311 is formed on the top surface of the first dielectric layer 31 of FIG. 4A. The conductor layer 311 is connected to the grounding terminals 24 and 26.

Figure 4B:
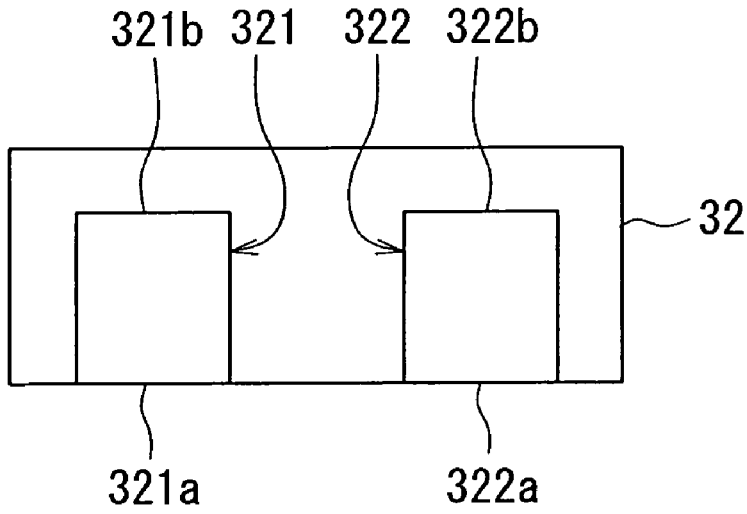

Resonator-forming conductor layers 321 and 322 are formed on the top surface of the second dielectric layer 32 of FIG. 4B. The conductor layer 321 has a short-circuited end 321*a*, and an open-circuited end 321*b* opposite thereto. The short-circuited end 321*a* is connected to the grounding terminal 26. The conductor layer 322 has a short-circuited end 322*a*, and an open-circuited end 322*b* opposite thereto. The short-circuited end 322*a* is connected to the grounding terminal 26.

Figure 4C:
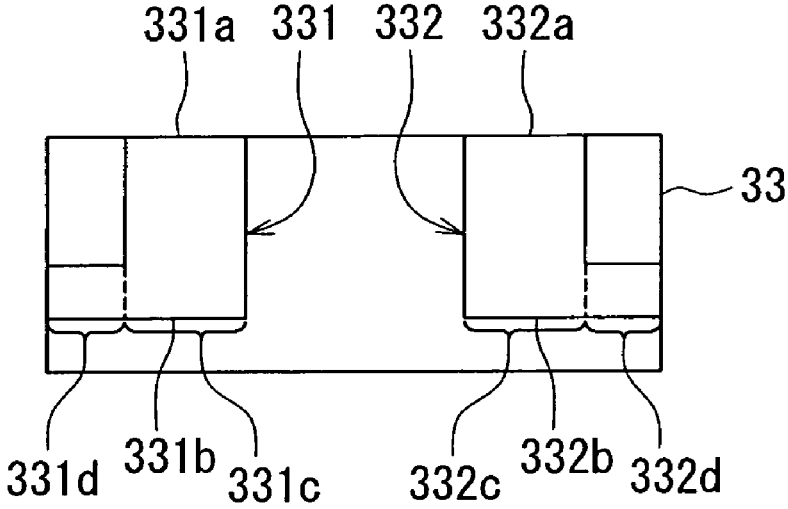

Resonator-forming conductor layers 331 and 332 are formed on the top surface of the third dielectric layer 33 of FIG. 4C. The conductor layer 331 has a short-circuited end 331*a*, and an open-circuited end 331*b* opposite thereto. The short-circuited end 331*a* is connected to the grounding terminal 24. The conductor layer 331 includes an inductor-forming portion 331*c* and a connecting portion 331*d*. The inductor-forming portion 331*c* extends in the vertical direction in FIG. 4C to connect the short-circuited end 331*a* and the open-circuited end 331*b* to each other. The connecting portion 331*d* extends in the horizontal direction in FIG. 4C to connect the inductor-forming portion 331*c* and the input terminal 22 to each other. The connecting portion 331*d* is connected to the input terminal 22. The conductor layer 332 has a short-circuited end 332*a*, and an open-circuited end 332*b* opposite thereto. The short-circuited end 332*a* is connected to the grounding terminal 25. The conductor layer 332 includes an inductor-forming portion 332*c* and a connecting portion 332*d*. The inductor-forming portion 332*c* extends in the vertical direction in FIG. 4C to connect the short-circuited end 332*a* and the open-circuited end 332*b* to each other. The connecting portion 332*d* extends in the horizontal direction in FIG. 4C to connect the inductor-forming portion 332*c* and the output terminal 23 to each other. The connecting portion 332*d* is connected to the output terminal 23.

Resonator-forming conductor layers 341 and 342 are formed on the top surface of the fourth dielectric layer 34 of FIG. 5A. The conductor layer 341 has a short-circuited end 341*a*, and an open-circuited end 341*b* opposite thereto. The short-circuited end 341*a* is connected to the grounding terminal 26. The conductor layer 342 has a short-circuited end 342*a*, and an open-circuited end 342*b* opposite thereto. The short-circuited end 342*a* is connected to the grounding terminal 26.

Resonator-forming conductor layers 351 and 352 are formed on the top surface of the fifth dielectric layer 35 of FIG. 5B. The conductor layer 351 has a short-circuited end 351*a*, and an open-circuited end 351*b* opposite thereto. The short-circuited end 351*a* is connected to the grounding terminal 24. The conductor layer 351 includes an inductor-forming portion 351*c* and a connecting portion 351*d*. The inductor-forming portion 351*c* extends in the vertical direction in FIG. 5B to connect the short-circuited end 351*a* and the open-circuited end 351*b* to each other. The connecting portion 351*d* extends in the horizontal direction in FIG. 5B to connect the inductor-forming portion 351*c* and the input terminal 22 to each other. The connecting portion 351*d* is connected to the input terminal 22. The conductor layer 352 has a short-circuited end 352*a*, and an open-circuited end 352*b* opposite thereto. The short-circuited end 352*a* is connected to the grounding terminal 25. The conductor layer 352 includes an inductor-forming portion 352*c* and a connecting portion 352*d*. The inductor-forming portion 352*c* extends in the vertical direction in FIG. 5B to connect the short-circuited end

352*a* and the open-circuited end 352*b* to each other. The connecting portion 352*d* extends in the horizontal direction in FIG. 5B to connect the inductor-forming portion 352*c* and the output terminal 23 to each other. The connecting portion 352*d* is connected to the output terminal 23.

Resonator-forming conductor layers 361 and 362 are formed on the top surface of the sixth dielectric layer 36 of FIG. 5C. The conductor layer 361 has a short-circuited end 361*a*, and an open-circuited end 361*b* opposite thereto. The short-circuited end 361*a* is connected to the grounding terminal 26. The conductor layer 362 has a short-circuited end 362*a*, and an open-circuited end 362*b* opposite thereto. The short-circuited end 362*a* is connected to the grounding terminal 26.

Resonator-forming conductor layers 371 and 372 are formed on the top surface of the seventh dielectric layer 37 of FIG. 6A. The conductor layer 371 has a short-circuited end 371*a*, and an open-circuited end 371*b* opposite thereto. The short-circuited end 371*a* is connected to the grounding terminal 24. The conductor layer 371 includes an inductor-forming portion 371*c*, a connecting portion 371*d*, and a capacitor-forming portion 371*e*. The inductor-forming portion 371*c* extends in the vertical direction in FIG. 6A to connect the short-circuited end 371*a* and the open-circuited end 371*b* to each other. The connecting portion 371*d* extends in the horizontal direction in FIG. 6A to connect the inductor-forming portion 371*c* and the input terminal 22 to each other. The connecting portion 371*d* is connected to the input terminal 22. The capacitor-forming portion 371*e* extends from the inductor-forming portion 371*c* toward the direction opposite to the connecting portion 371*d*. The conductor layer 372 has a short-circuited end 372*a*, and an open-circuited end 372*b* opposite thereto. The short-circuited end 372*a* is connected to the grounding terminal 25. The conductor layer 372 includes an inductor-forming portion 372*c* and a connecting portion 372*d*. The inductor-forming portion 372*c* extends in the vertical direction in FIG. 6A to connect the short-circuited end 372*a* and the open-circuited end 372*b* to each other. The connecting portion 372*d* extends in the horizontal direction in FIG. 6A to connect the inductor-forming portion 372*c* and the output terminal 23 to each other. The connecting portion 372*d* is connected to the output terminal 23.

Resonator-forming conductor layers 381 and 382 are formed on the top surface of the eighth dielectric layer 38 of FIG. 6B. The conductor layer 381 has a short-circuited end 381*a*, and an open-circuited end 381*b* opposite thereto. The short-circuited end 381*a* is connected to the grounding terminal 26. The conductor layer 382 has a short-circuited end 382*a*, and an open-circuited end 382*b* opposite thereto. The short-circuited end 382*a* is connected to the grounding terminal 26.

Resonator-forming conductor layers 391 and 392 are formed on the top surface of the ninth dielectric layer 39 of FIG. 6C. The conductor layer 391 has a short-circuited end 391*a*, and an open-circuited end 391*b* opposite thereto. The short-circuited end 391*a* is connected to the grounding terminal 24. The conductor layer 391 includes an inductor-forming portion 391*c* and a connecting portion 391*d*. The inductor-forming portion 391*c* extends in the vertical direction in FIG. 6C to connect the short-circuited end 391*a* and the open-circuited end 391*b* to each other. The connecting portion 391*d* extends in the horizontal direction in FIG. 6C to connect the inductor-forming portion 391*c* and the input terminal 22 to each other. The connecting portion 391*d* is connected to the input terminal 22. The conductor layer 392 has a short-circuited end 392*a*, and an open-circuited end 392*b* opposite thereto. The short-circuited end 392*a* is connected to the grounding terminal 25. The conductor layer 392 includes an inductor-forming portion 392*c*, a connecting portion 392*d*, and a capacitor-forming portion 392*e*. The inductor-forming portion 392*c* extends in the vertical direction in FIG. 6C to connect the short-circuited end 392*a* and the open-circuited end 392*b* to each other. The connecting portion 392*d* extends in the horizontal direction in FIG. 6C to connect the inductor-forming portion 392*c* and the output terminal 23 to each other. The connecting portion 392*d* is connected to the output terminal 23. The capacitor-forming portion 392*e* extends from the inductor-forming portion 392*c* toward the direction opposite to the connecting portion 392*d*.

Resonator-forming conductor layers 401 and 402 are formed on the top surface of the tenth dielectric layer 40 of FIG. 6D. The conductor layer 401 has a short-circuited end 401*a*, and an open-circuited end 401*b* opposite thereto. The short-circuited end 401*a* is connected to the grounding terminal 26. The conductor layer 402 has a short-circuited end 402*a*, and an open-circuited end 402*b* opposite thereto. The short-circuited end 402*a* is connected to the grounding terminal 26.

Resonator-forming conductor layers 411 and 412 are formed on the top surface of the eleventh dielectric layer 41 of FIG. 7A. The conductor layer 411 has a short-circuited end 411*a*, and an open-circuited end 411*b* opposite thereto. The short-circuited end 411*a* is connected to the grounding terminal 24. The conductor layer 411 includes an inductor-forming portion 411*c* and a connecting portion 411*d*. The inductor-forming portion 411*c* extends in the vertical direction in FIG. 7A to connect the short-circuited end 411*a* and the open-circuited end 411*b* to each other. The connecting portion 411*d* extends in the horizontal direction in FIG. 7A to connect the inductor-forming portion 411*c* and the input terminal 22 to each other. The connecting portion 411*d* is connected to the input terminal 22. The conductor layer 412 has a short-circuited end 412*a*, and an open-circuited end 412*b* opposite thereto. The short-circuited end 412*a* is connected to the grounding terminal 25. The conductor layer 412 includes an inductor-forming portion 412*c* and a connecting portion 412*d*. The inductor-forming portion 412*c* extends in the vertical direction in FIG. 7A to connect the short-circuited end 412*a* and the open-circuited end 412*b* to each other. The connecting portion 412*d* extends in the horizontal direction in FIG. 7A to connect the inductor-forming portion 412*c* and the output terminal 23 to each other. The connecting portion 412*d* is connected to the output terminal 23.

Resonator-forming conductor layers 421 and 422 are formed on the top surface of the twelfth dielectric layer 42 of FIG. 7B. The conductor layer 421 has a short-circuited end 421*a*, and an open-circuited end 421*b* opposite thereto. The short-circuited end 421*a* is connected to the grounding terminal 26. The conductor layer 422 has a short-circuited end 422*a*, and an open-circuited end 422*b* opposite thereto. The short-circuited end 422*a* is connected to the grounding terminal 26.

As shown in FIG. 7C, a grounding conductor layer 423 is formed on the bottom surface of the dielectric layer 42. The conductor layer 423 is connected to the grounding terminals 25 and 26.

The conductor layers 321, 331, 341, 351, 361, 371, 381, 391, 401 and 411 each have the short-circuited end and the open-circuited end, and are arranged in the direction in which the plurality of dielectric layers are stacked, such that the relative positions of the short-circuited end and the open-circuited end are alternately reversed. The conductor layers 331, 351, 371, 391 and 411 are the same in relative positions of the short-circuited end and the open-circuited end. These conductor layers 331, 351, 371, 391 and 411 will be hereinafter called resonator-forming conductor layers of a first type. The conductor layers 321, 341, 361, 381, 401 and 421 are the same in relative positions of the short-circuited end and the open-circuited end. These conductor layers 321, 341, 361, 381, 401 and 421 will be hereinafter called resonator-forming conductor layers of a second type. The relative positions of the short-circuited end and the open-circuited end are reversed between the resonator-forming conductor layers of the first type 331, 351, 371, 391, 411 and the second type 321, 341, 361, 381, 401, 421. Thus, the resonator-forming conductor layers of the first type and the second type, being reversed in relative positions of the short-circuited end and the open-circuited end, are alternately arranged in the direction in which the plurality of dielectric layers are stacked, so that the resonator-forming conductor layers of the two different types are adjacent to each other.

The resonator-forming conductor layers of the first type 331, 351, 371, 391 and 411 respectively include the connecting portions 331*d*, 351*d*, 371*d*, 391*d* and 411*d* connected to the input terminal 22. Thus, the input terminal 22 is directly connected to all of the resonator-forming conductor layers of the first type 331, 351, 371, 391 and 411.

The resonator-forming conductor layers of the first type 331, 351, 371, 391, 411 and the second type 321, 341, 361, 381, 401, 421 are interdigital-coupled to each other, thereby constituting the inductor 11 of the resonator 4. The conductor layers 311, 321, 331, 341, 351, 361, 371, 381, 391, 401, 411 and 421 and the dielectric layers located between every adjacent two of these conductor layers constitute the capacitor 13 of the resonator 4.

The conductor layers 322, 332, 342, 352, 362, 372, 382, 392, 402 and 412 each have the short-circuited end and the open-circuited end, and are arranged in the direction in which the plurality of dielectric layers are stacked, such that the relative positions of the short-circuited end and the open-circuited end are alternately reversed. The conductor layers 332, 352, 372, 392 and 412 are the same in relative positions of the short-circuited end and the open-circuited end. These conductor layers 332, 352, 372, 392 and 412 will be hereinafter called resonator-forming conductor layers of a third type. The conductor layers 322, 342, 362, 382, 402 and 422 are the same in relative positions of the short-circuited end and the open-circuited end. These conductor layers 322, 342, 362, 382, 402 and 422 will be hereinafter called resonator-forming conductor layers of a fourth type. The relative positions of the short-circuited end and the open-circuited end are reversed between the resonator-forming conductor layers of the third type 332, 352, 372, 392, 412 and the fourth type 322, 342, 362, 382, 402, 422. Thus, the resonator-forming conductor layers of the third type and the fourth type, being reversed in relative positions of the short-circuited end and the open-circuited end, are alternately arranged in the direction in which the plurality of dielectric layers are stacked, so that the resonator-forming conductor layers of the two different types are adjacent to each other.

The resonator-forming conductor layers of the third type 332, 352, 372, 392 and 412 respectively include the connecting portions 332*d*, 352*d*, 372*d*, 392*d* and 412*d* connected to the output terminal 23. Thus, the output terminal 23 is directly connected to all of the resonator-forming conductor layers of the third type 332, 352, 372, 392 and 412.

The resonator-forming conductor layers of the third type 332, 352, 372, 392, 412 and the fourth type 322, 342, 362, 382, 402, 422 are interdigital-coupled to each other, thereby constituting the inductor 12 of the resonator 5. The conductor layers 322, 332, 342, 352, 362, 372, 382, 392, 402, 412, 422 and 423 and the dielectric layers located between every adjacent two of these conductor layers constitute the capacitor 14 of the resonator 5.

The capacitor-forming portion 371*e* of the conductor layer 371, the capacitor-forming portion 392*e* of the conductor layer 392, and the dielectric layers 37 and 38 constitute the capacitor 15 of FIG. 3.

The first to twelfth dielectric layers 31 to 42 and the conductor layers described above are stacked to form the layered substrate 20 shown in FIG. 1 and FIG. 2. The terminals 22 to 26 shown in FIG. 2 are formed on the periphery of the layered substrate 20.

In the present embodiment, a variety of types of substrates are employable as the layered substrate 20, such as one in which the dielectric layers are formed of a resin, ceramic, or a resin-ceramic composite material. However, a low-temperature co-fired ceramic multilayer substrate, which is excellent in high frequency response, is particularly preferable as the layered substrate 20.

In the present embodiment, the resonators 4 and 5 respectively include the inductors 11 and 12 each of which is formed of the resonator-forming conductor layers of the two different types that are interdigital-coupled to each other. According to the present embodiment, it is possible to increase the Qs of the inductors 11 and 12 and consequently increase the Qs of the resonators 4 and 5, compared with a case in which the inductors of the resonator 4 and 5 are each formed only of a single resonator-forming conductor layer.

In the present embodiment, the resonator-forming conductor layers of the first type 331, 351, 371, 391 and 411 respectively include the connecting portions 331*d*, 351*d*, 371*d*, 391*d* and 411*d* that respectively connect the inductor-forming portions 331*c*, 351*c*, 371*c*, 391*c* and 411*c* to the input terminal 22. On the other hand, the resonator-forming conductor layers of the third type 332, 352, 372, 392 and 412 respectively include the connecting portions 332*d*, 352*d*, 372*d*, 392*d* and 412*d* that respectively connect the inductor-forming portions 332*c*, 352*c*, 372*c*, 392*c* and 412*c* to the output terminal 23. The configuration in which the inductor-forming portions are connected to the input terminal 22 or the output terminal 23 through the connecting portions as described above makes it easy to adjust the impedances of the resonator-forming conductor layers as seen from the input terminal 22 or the output terminal 23 during the design phase of the electronic component 1, and consequently makes it easy to obtain matching at the input terminal 22 or the output terminal 23. This will now be explained with reference to the results of a first simulation.

Figure 8:
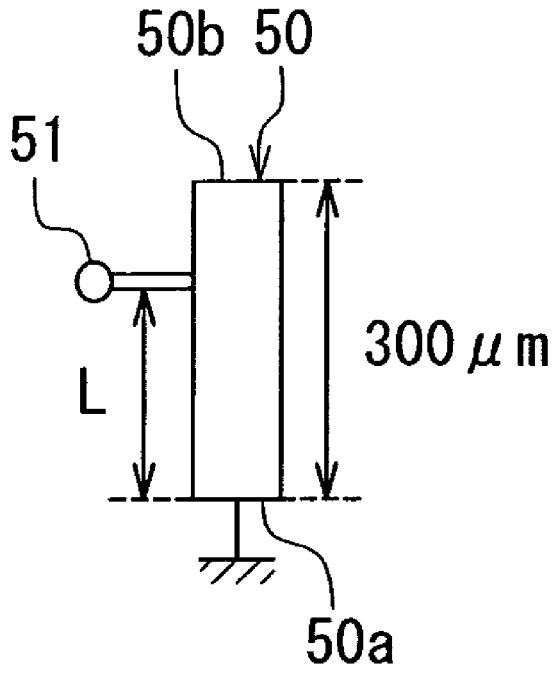
FIG. 8 is an illustrative view showing a model used in a first simulation.

FIG. 8 is an illustrative view showing a model used in the first simulation. This model has a resonator-forming conductor layer 50 having a length of 300 μm and having a short-circuited end 50*a* and an open-circuited end 50*b*, with a terminal 51 connected to the conductor layer 50 at a point L μm apart from the short-circuited end 50*a*. The length of the resonator-forming conductor layer 50 is equal to a quarter of the wavelength of a signal inputted to the terminal 51.

Figure 9:
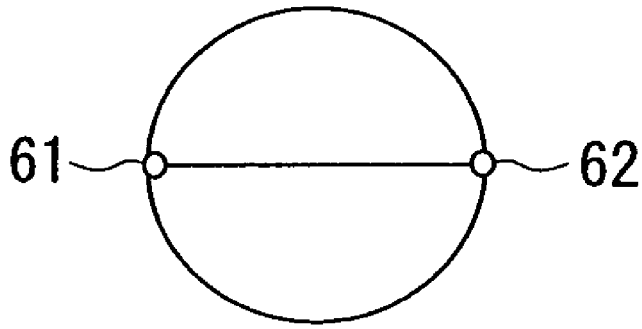
FIG. 9 is an illustrative view showing a Smith chart of impedance in a simplified manner.

Reference is now made to FIG. 9 to describe the impedance of the resonator-forming conductor layer 50 of the model of FIG. 8 as seen from the terminal 51. FIG. 9 shows the Smith chart of the impedance in a simplified manner. In the model of FIG. 8, assuming that the terminal 51 is connected to the short-circuited end 50*a*, or in other words, assuming that L is 0 (μm), the impedance Zin of the resonator-forming conductor layer 50 as seen from the terminal 51 is represented by the point 61 of FIG. 9, in principle. In the Smith chart of FIG. 9 the point 61 indicates that the impedance is zero. On the other hand, assuming that the terminal 51 is connected to the open-circuited end 50*b*, or in other words, assuming that L is 300 (μm), the impedance Zin is represented by the point 62 of FIG. 9, in principle. In the Smith chart of FIG. 9 the point 62 indicates that the impedance is infinite. When L is varied from 0 (μm) to 300 (μm) in the model of FIG. 8, the point representing the impedance Zin moves from the point 61 to the point 62 in the Smith chart of FIG. 9. In other words, varying L from 0 (μm) to 300 (μm) varies the impedance Zin from zero to infinity.

Figure 10:
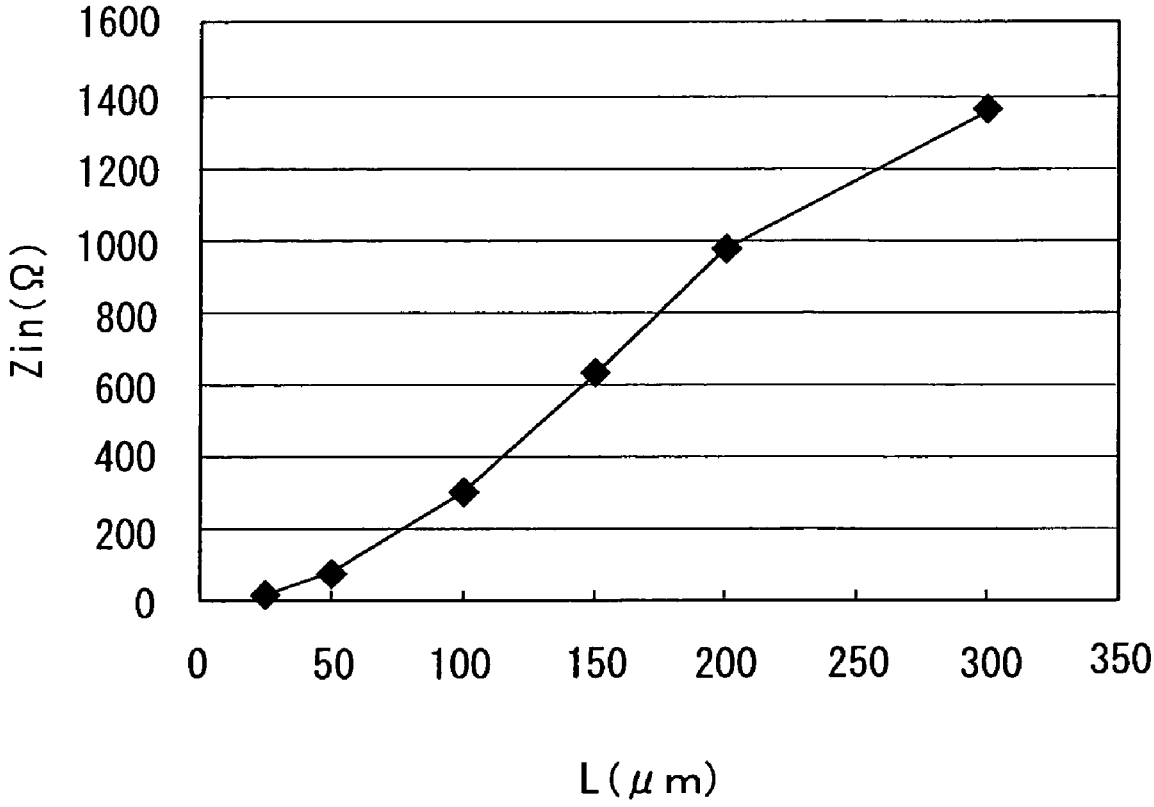
FIG. 10 is a plot showing the results of the first simulation.

FIG. 10 is a plot showing the relationship between the length L and the impedance Zin obtained from the first simulation. FIG. 10 shows that in the model of FIG. 8 the impedance Zin increases as the length L increases.

As can be seen from the above result of the first simulation, according to the present embodiment, it is possible to change the impedances of the resonator-forming conductor layers of the first type as seen from the input terminal 22 by changing the positions at which the connecting portions are connected to the inductor-forming portions between the short-circuited end and the open-circuited end in the resonator-forming conductor layers of the first type. Similarly, it is possible to change the impedances of the resonator-forming conductor layers of the third type as seen from the output terminal 23 by changing the positions at which the connecting portions are connected to the inductor-forming portions between the short-circuited end and the open-circuited end in the resonator-forming conductor layers of the third type. Thus, the present embodiment makes it easy to adjust the impedances of the resonator-forming conductor layers as seen from the input terminal 22 or the output terminal 23 during the design phase of the electronic component 1, and consequently makes it easy to obtain matching at the input terminal 22 or the output terminal 23.

FIG. 4A to FIG. 7C show that each of the connecting portions of the resonator-forming conductor layers of the first type or the third type is disposed such that one end thereof coincides with the short-circuited end. However, in order to adjust the impedances of the resonator-forming conductor layers as seen from the input terminal 22 or the output terminal 23 on the basis of the above-described principle, the connecting portions may be connected to the inductor-forming portions at any point between the short-circuited end and the open-circuited end.

In the present embodiment, the input terminal 22 is directly connected to all of the resonator-forming conductor layers of the first type 331, 351, 371, 391 and 411. Similarly, the output terminal 23 is directly connected to all of the resonator-forming conductor layers of the third type 332, 352, 372, 392 and 412. The advantages of these features will now be described with reference to the results of a second simulation.

FIG. 11 to FIG. 14 respectively illustrate first to fourth models used in the second simulation. Each of the first to fourth models has resonator-forming conductor layers of the first type 111, 112, 113 and 114, and resonator-forming conductor layers of the second type 121, 122 and 123. The resonator-forming conductor layers of the first type and the second type are alternately arranged in the direction in which a plurality of dielectric layers are stacked, so that the resonator-forming conductor layers of the two different types are adjacent to each other.

Figure 11:
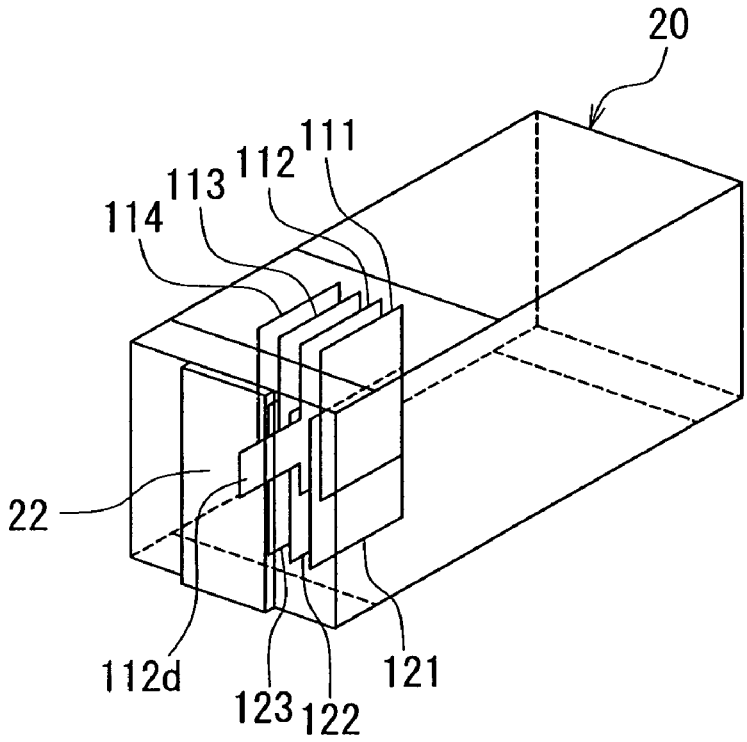
FIG. 11 is an illustrative view showing a first model used in a second simulation.

In the first model shown in FIG. 11, of the four resonator-forming conductor layers of the first type 111, 112, 113 and 114, only the conductor layer 112 has a connecting portion 112*d* and is connected to the input terminal 22.

Figure 12:
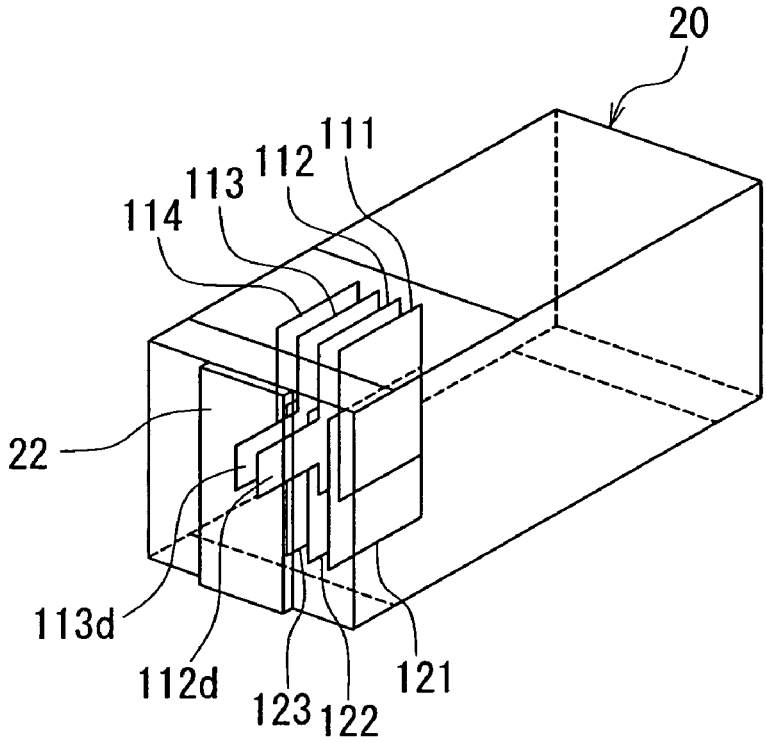
FIG. 12 is an illustrative view showing a second model used in the second simulation.

In the second model shown in FIG. 12, of the four resonator-forming conductor layers of the first type 111, 112, 113 and 114, only the conductor layers 112 and 113 have connecting portions 112*d* and 113*d*, respectively, and are connected to the input terminal 22.

Figure 13:
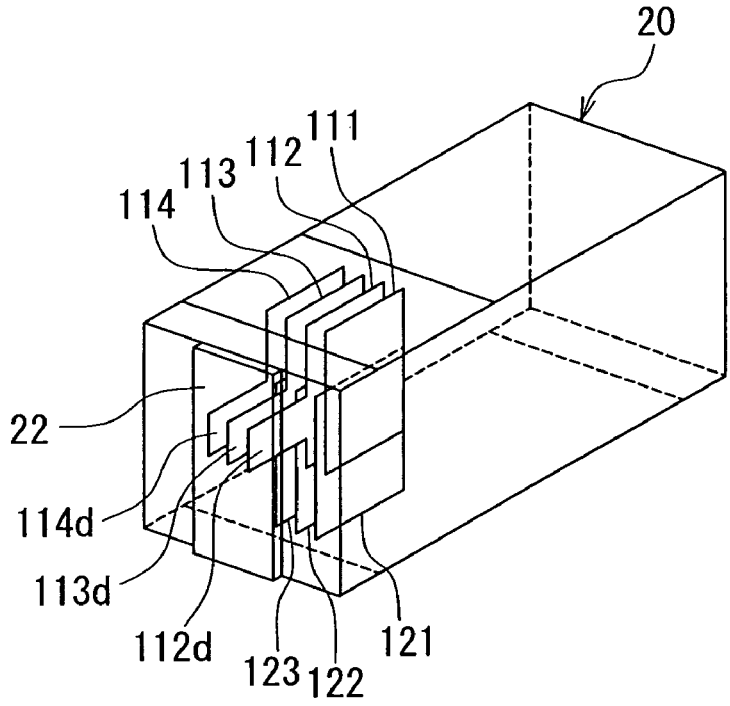
FIG. 13 is an illustrative view showing a third model used in the second simulation.

In the third model shown in FIG. 13, of the four resonator-forming conductor layers of the first type 111, 112, 113 and 114, only the conductor layers 112, 113 and 114 have connecting portions 112*d*, 113*d* and 114*d*, respectively, and are connected to the input terminal 22.

Figure 14:
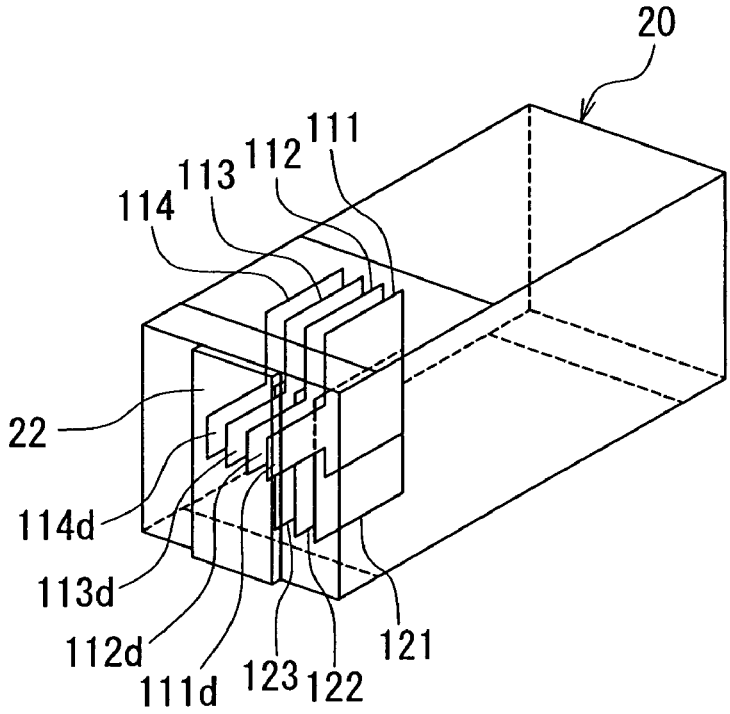
FIG. 14 is an illustrative view showing a fourth model used in the second simulation.

In the fourth model shown in FIG. 14, all of the four resonator-forming conductor layers of the first type 111, 112, 113 and 114 have connecting portions 111*d*, 112*d*, 113*d* and 114*d*, respectively, and are connected to the input terminal 22.

Figure 15:
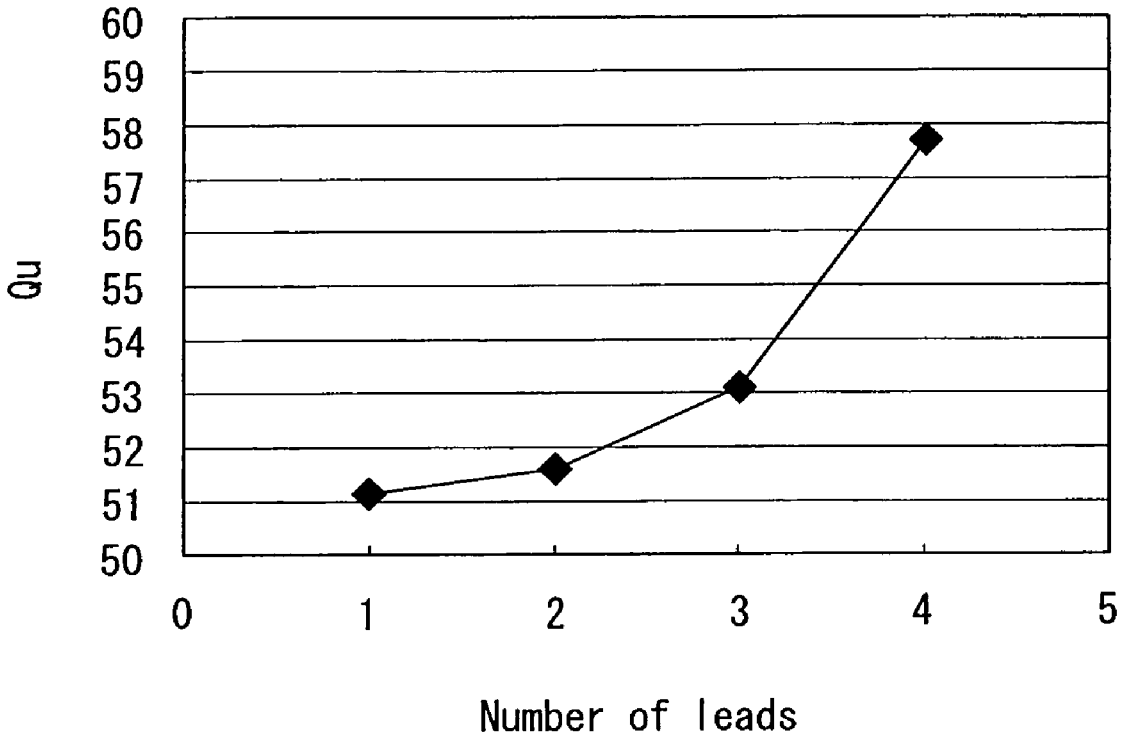
FIG. 15 is a plot showing the results of the second simulation.

In the second simulation, Q under no load (hereinafter, Qu) was determined for an inductor formed of the resonator-forming conductor layers of the first type and the second type in each of the first to fourth models. The results are shown in FIG. 15. In FIG. 15 the "number of leads" on the horizontal axis refers to the number of the connecting portions. The number of leads in the first, second, third and fourth models is one, two, three and four, respectively. FIG. 15 shows that the Qu of the inductor increases as the number of leads increases. In particular, when the number of leads is four, or in other words, when the input terminal 22 is directly connected to all of the resonator-forming conductor layers of the first type, the Qu of the inductor is remarkably higher than in the other cases.

As can be seen from the results of the second simulation, according to the present embodiment, the feature that the input terminal 22 is directly connected to all of the resonator-forming conductor layers of the first type serves to increase the Q of the inductor formed of the resonator-forming conductor layers of the first type and the second type, and consequently serves to increase the Q of the resonator 4 connected to the input terminal 22.

Similarly, the feature that the output terminal 23 is directly connected to all of the resonator-forming conductor layers of the third type serves to increase the Q of the inductor formed of the resonator-forming conductor layers of the third type and the fourth type, and consequently serves to increase the Q of the resonator 5 connected to the output terminal 23.

Figure 16:
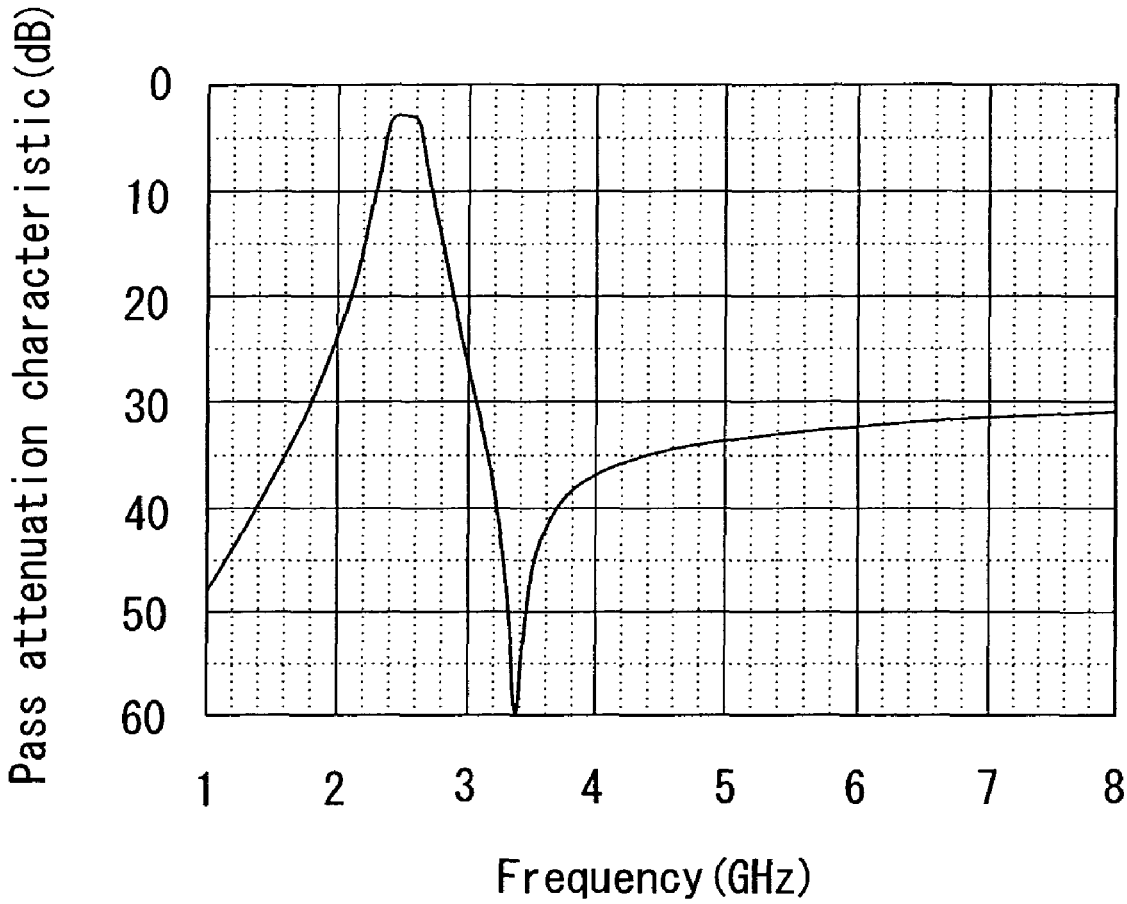
FIG. 16 is a plot showing the pass attenuation characteristic of the electronic component of the embodiment of the invention.

The electronic component 1 of the present embodiment is designed to function as a bandpass filter having a passband of, for example, approximately 2.4 to 2.5 GHz. The 2.4 to 2.5 GHz band corresponds to the passband of a bandpass filter for use in a communication apparatus conforming to the Bluetooth standard and a communication apparatus for use on a wireless LAN. FIG. 16 shows an example of the pass attenuation characteristic of the electronic component 1 of the present embodiment obtained by simulation. For this simulation, the electronic component 1 is designed to function as a bandpass filter having a passband of approximately 2.4 to 2.5 GHz.

The present invention is not limited to the foregoing embodiment but can be carried out in various modifications. For example, in the present invention, while a plurality of resonator-forming conductor layers are required for each of the first type and the third type, the number of the resonator-forming conductor layers of the second type and the fourth type may be one each.

The electronic component of the present invention is applicable not only to a bandpass filter but also to any electronic component including at least one resonator. For example, the electronic component of the present invention may be a notch filter including one resonator and a terminal connected to the resonator and used for input and output of signals. The electronic component of the present invention may include three or more resonators provided within the layered substrate such that every adjacent two of the resonators are inductively coupled to each other.

The electronic component of the present invention is useful as a filter, or a bandpass filter, in particular, for use in a communication apparatus conforming to the Bluetooth standard or a communication apparatus for use on a wireless LAN.

It is apparent that the present invention can be carried out in various forms and modifications in the light of the foregoing descriptions. Accordingly, within the scope of the following claims and equivalents thereof, the present invention can be carried out in forms other than the foregoing most preferred embodiment.

What is claimed is:

1. An electronic component comprising:

a layered substrate including a plurality of dielectric layers stacked;

a terminal provided on a periphery of the layered substrate and used for at least one of input and output of signals; and a resonator provided within the layered substrate and connected to the terminal, wherein:

the resonator includes a plurality of resonator-forming conductor layers of a first type and at least one resonator-forming conductor layer of a second type;

the resonator-forming conductor layers of the first type and the second type each have a short-circuited end and an open-circuited end, relative positions of the short-circuited end and the open-circuited end being reversed between the first and second types, and the resonator-forming conductor layers of the first type and the second type are alternately arranged in a direction in which the plurality of dielectric layers are stacked; and the terminal is directly connected to all of the resonator-forming conductor layers of the first type.

2. The electronic component according to claim 1, wherein the resonator is a quarter-wave resonator having a short-circuited end and an open-circuited end.

3. An electronic component comprising:

a layered substrate including a plurality of dielectric layers stacked;

an input terminal provided on a periphery of the layered substrate and used for input of input signals;

an output terminal provided on the periphery of the layered substrate and used for output of output signals;

a first resonator provided within the layered substrate and connected to the input terminal; and a second resonator provided within the layered substrate and connected to the output terminal, wherein:

the first resonator includes a plurality of resonator-forming conductor layers of a first type and at least one resonator-forming conductor layer of a second type;

the resonator-forming conductor layers of the first type and the second type each have a short-circuited end and an open-circuited end, relative positions of the short-circuited end and the open-circuited end being reversed between the first and second types, and the resonator-forming conductor layers of the first type and the second type are alternately arranged in a direction in which the plurality of dielectric layers are stacked;

the input terminal is directly connected to all of the resonator-forming conductor layers of the first type;

the second resonator includes a plurality of resonator-forming conductor layers of a third type and at least one resonator-forming conductor layer of a fourth type;

the resonator-forming conductor layers of the third type and the fourth type each have a short-circuited end and an open-circuited end, relative positions of the short-circuited end and the open-circuited end being reversed between the third and fourth types, and the resonator-forming conductor layers of the third type and the fourth type are alternately arranged in the direction in which the plurality of dielectric layers are stacked; and the output terminal is directly connected to all of the resonator-forming conductor layers of the third type.

4. The electronic component according to claim 3, wherein each of the first and second resonators is a quarter-wave resonator having a short-circuited end and an open-circuited end.

5. The electronic component according to claim 3, wherein the first and second resonators are located between the input terminal and the output terminal in terms of circuit configuration, and implemented to function as a bandpass filter.

* * * * *